US005197924A

United States Patent [19]

Gerrells

[11] Patent Number: 5,197,924

[45] Date of Patent: Mar. 30, 1993

[54] TOY STAIRWAY SLIDE APPARATUS

[76] Inventor: Kristie Gerrells, Rte. 5, Box 7, Devils Lake, N. Dak. 58301

[21] Appl. No.: 779,056

[22] Filed: Oct. 18, 1991

[51] Int. Cl.[5] ..... A63H 29/08; A63H 33/00

[52] U.S. Cl. ..... 472/116; 446/168; 446/487; 446/489

[58] Field of Search ..... 446/104, 108, 109, 122, 446/168, 476, 478, 487, 489; 472/116

[56] References Cited

U.S. PATENT DOCUMENTS

| | | | |
|---|---|---|---|
| 788,818 | 5/1905 | Briggs et al. | 472/116 X |
| 1,569,066 | 1/1926 | Beiger | 446/108 |
| 2,270,909 | 1/1942 | Spizer | 472/116 |
| 2,729,914 | 1/1956 | Cook | 446/168 |
| 2,917,864 | 12/1959 | Payne | 446/168 |
| 3,561,757 | 2/1971 | Schillig | 446/104 X |
| 3,743,281 | 7/1973 | Gimbel | 472/116 |
| 3,946,516 | 3/1976 | Wirth | 446/168 X |
| 4,813,663 | 3/1989 | Rice | 472/116 |
| 4,943,048 | 7/1990 | Hentges | 472/116 |

*Primary Examiner*—D. Neal Muir
*Attorney, Agent, or Firm*—Leon Gilden

[57] ABSTRACT

A slide apparatus is arranged for mounting to a stairway relative to an uppermost and lowermost stair vertical wall, with a first anchor member mounted to the uppermost vertical wall and a lowermost vertical wall mounting a second anchor member thereto and to the associated floor surface. A plurality of aligned slide blocks are arranged in a pivotal interconnected relationship relative to one another configured for pivotal association to accommodate various undulations in the arrangement of an individual utilizing the organization in a sliding fashion.

6 Claims, 4 Drawing Sheets

TOY STAIRWAY SLIDE APPARATUS

BACKGROUND OF THE INVENTION

1. Field of the Invention

The field of invention relates to toy apparatus, and more particularly pertains to a new and improved toy stairway slide apparatus wherein the same is arranged for mounting to an associated stairway.

2. Description of the Prior Art

Various toy apparatus of various types are utilized in the prior art in a building block fashion to construct various toy components. Such is exemplified in U.S. Pat. No. 4,556,394 to Chen wherein a toy building block set is arranged to form a configuration utilizing a flotation member to permit the organization to float within a body of water.

U.S. Pat. No. 4,708,684 to Chen sets forth a further example of a building block organization, wherein a plurality of connecting elements and sockets are provided to interconnect various components together.

U.S. Pat. No. 4,789,369 to Lyman sets forth toy building blocks utilizing pivotal interconnections to construct an animal-like simulation.

As such, it may be appreciated that there continues to be a need for a new and improved toy stairway slide apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of building block apparatus now present in the prior art, the present invention provides a toy stairway slide apparatus wherein the same is arranged to permit pivotal interconnection of various block components to provide for a slide arrangement mounted to a stairway. As such, the general purpose of the present invention, which will be described subsequently in greater detail, is to provide a new and improved toy stairway slide apparatus which has all the advantages of the prior art toy block apparatus and none of the disadvantages.

To attain this, the present invention provides a slide apparatus arranged for mounting to a stairway relative to an uppermost and lowermost stair vertical wall, with a first anchor member mounted to the uppermost vertical wall and a lowermost vertical wall mounting a second anchor member thereto and to the associated floor surface. A plurality of aligned slide blocks are arranged in a pivotal interconnected relationship relative to one another configured for pivotal association to accommodate various undulations in the arrangement of an individual utilizing the organization in a sliding fashion.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy stairway slide apparatus which has all the advantages of the prior art toy block apparatus and none of the disadvantages.

It is another object of the present invention to provide a new and improved toy stairway slide apparatus which may be easily and efficiently manufactured and marketed.

It is a further object of the present invention to provide a new and improved toy stairway slide apparatus which is of a durable and reliable construction.

An even further object of the present invention is to provide a new and improved toy stairway slide apparatus which is susceptible of a low cost of manufacture with regard to both materials and labor, and which accordingly is then susceptible of low prices of sale to the consuming public, thereby making such toy stairway slide apparatus economically available to the buying public.

Still yet another object of the present invention is to provide a new and improved toy stairway slide apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 16:
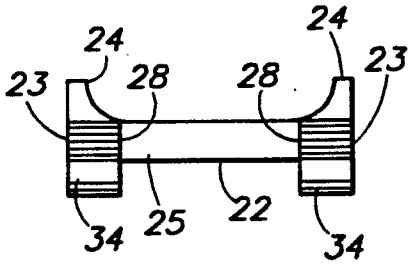
FIG. 16 is an end orthographic view, taken along the lines 16—16 of FIG. 1 in the direction indicated by the arrows.

With reference now to the drawings, and in particular to FIGS. 1 to 16 thereof, a new and improved toy stairway slide apparatus embodying the principles and concepts of the present invention and generally designated by the reference numeral 10 will be described.

Figure 1:
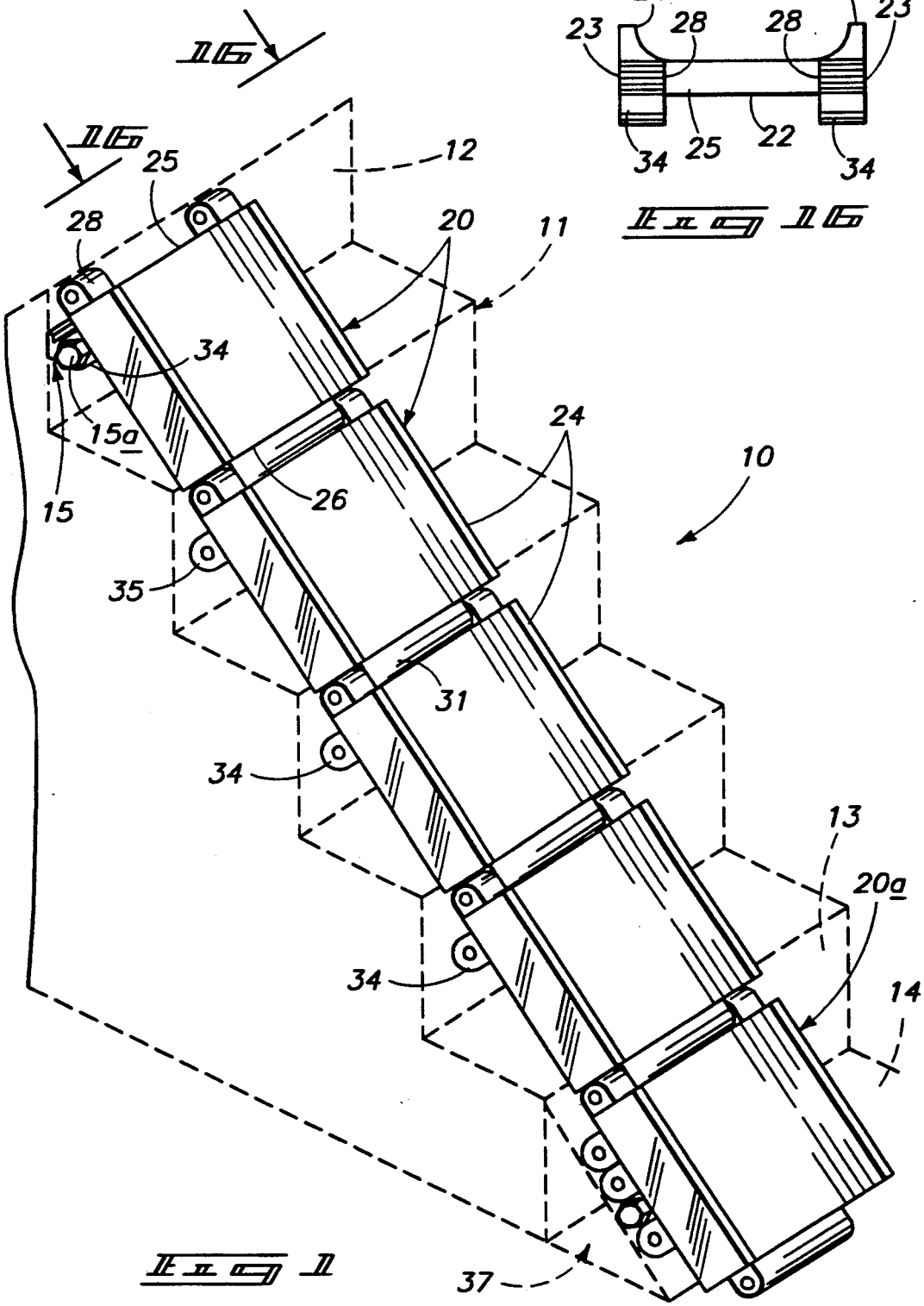
FIG. 1 is an isometric illustration of the instant invention.
Figure 2:
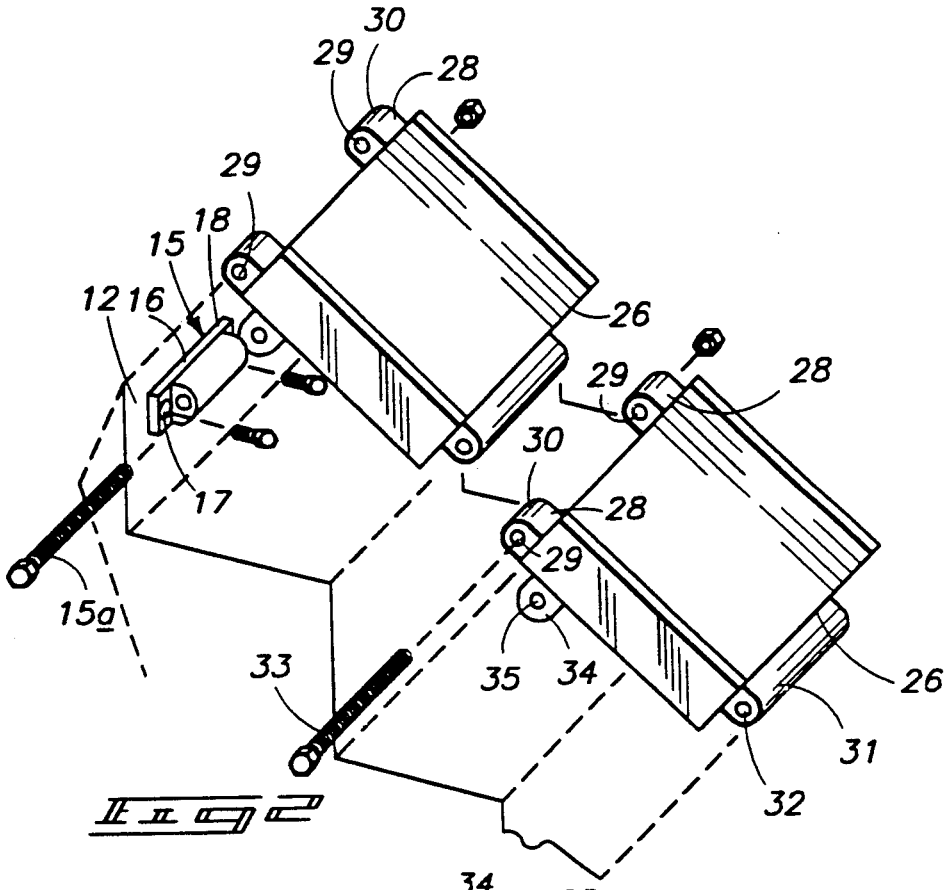
FIG. 2 is an isometric illustration of the instant invention in a disassembled configuration illustrating the uppermost block relative to the uppermost anchor.
Figure 3:
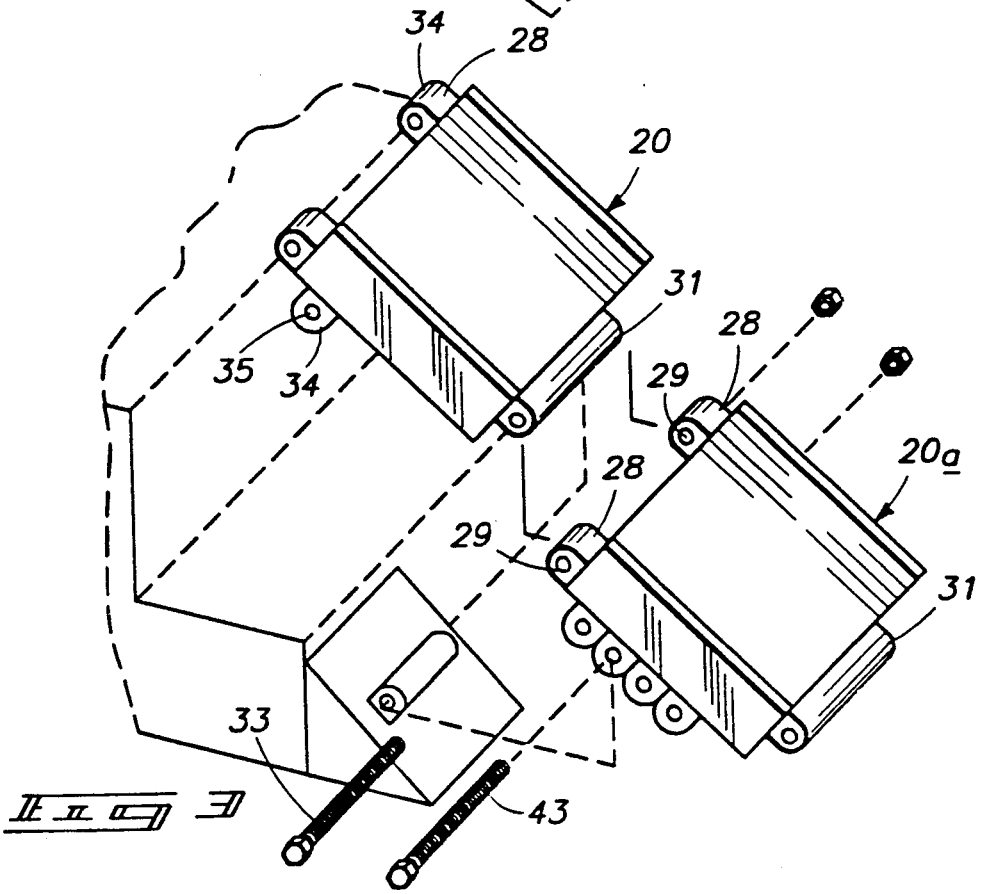
FIG. 3 is an isometric illustration of the instant invention in a somewhat exploded view illustrating the lowermost block mounted to a lowermost end portion of the stairway.
Figure 4:
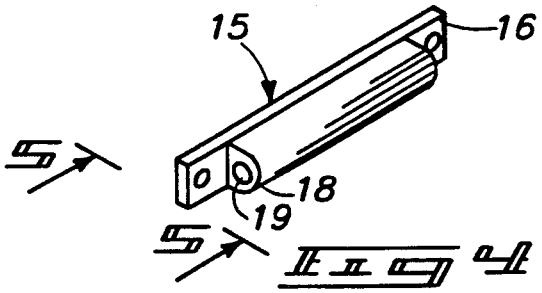
FIG. 4 is an isometric illustration of the first anchor member.
Figure 5:
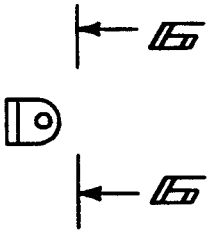
FIG. 5 is an orthographic view, taken along the lines 5—5 of FIG. 4 in the direction indicated by the arrows.
Figure 6:
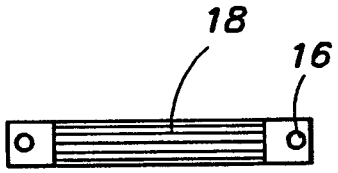
FIG. 6 is an orthographic view, taken along the lines 6—6 of FIG. 5 in the direction indicated by the arrows.
Figure 7:
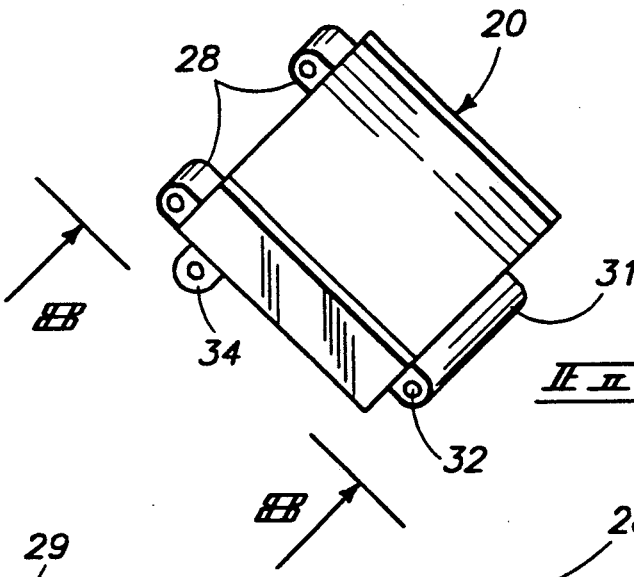
FIG. 7 is an isometric illustration of a slide block member.
Figure 8:
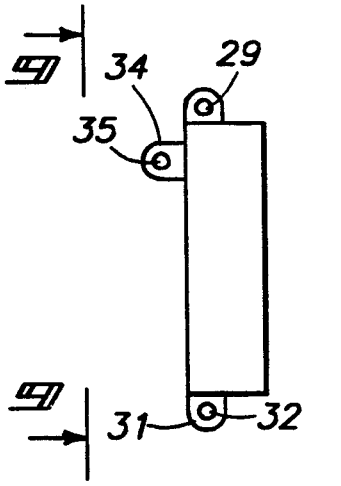
FIG. 8 is an orthographic view, taken along the lines 8—8 of FIG. 7 in the direction indicated by the arrows.
Figure 9:
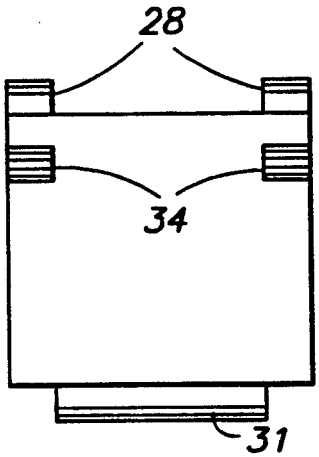
FIG. 9 is an orthographic view, taken along the lines 9—9 of FIG. 8 in the direction indicated by the arrows.
Figure 10:
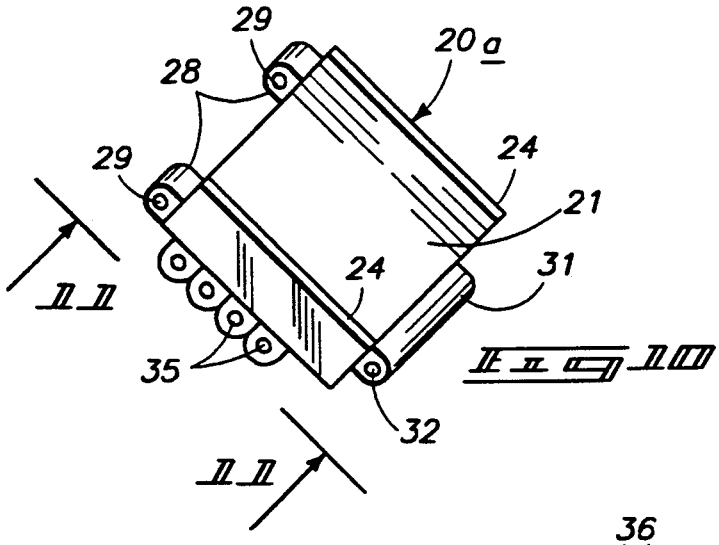
FIG. 10 is an isometric illustration of a lowermost block member utilized by the invention.
Figure 11:
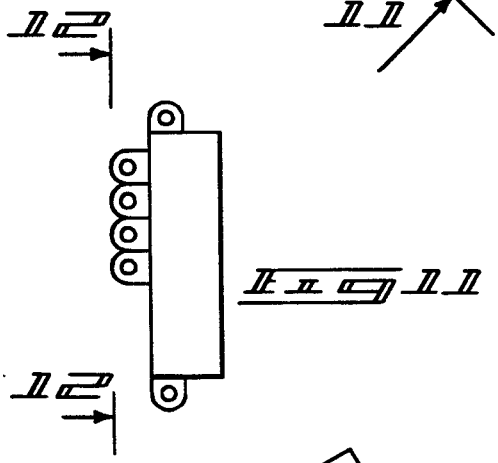
FIG. 11 is an orthographic view, taken along the lines 11—11 of FIG. 10 in the direction indicated by the arrows.
Figure 12:
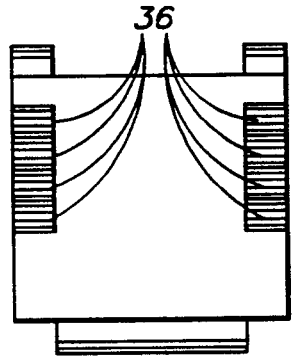
FIG. 12 is an orthographic view, taken along the lines 12—12 of FIG. 11 in the direction indicated by the arrows.
Figure 13:
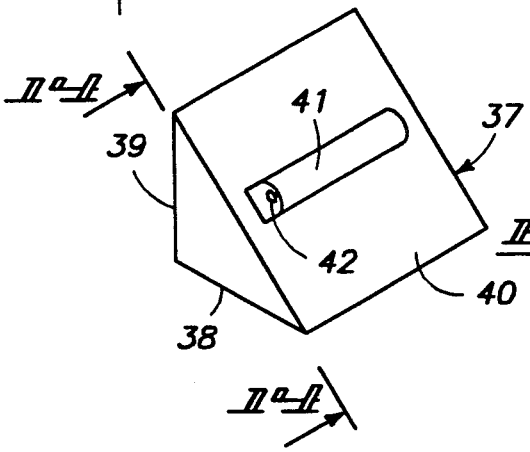
FIG. 13 is an isometric illustration of the second anchor member utilized by the invention.
Figure 14:
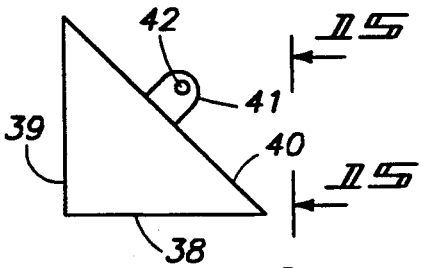
FIG. 14 is an orthographic view, taken along the lines 14—14 of FIG. 13 in the direction indicated by the arrows.
Figure 15:
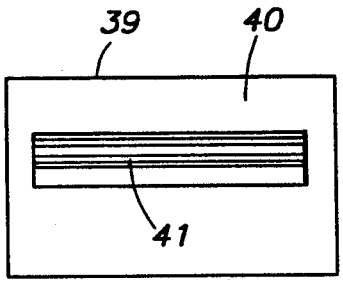
FIG. 15 is an orthographic view, taken along the lines 15—15 of FIG. 14 in the direction indicated by the arrows.

More specifically, the toy stairway slide apparatus 10 of the instant invention essentially comprises the apparatus mounted to a stairway 11 that includes an uppermost stair vertical wall 12 and a lowermost stair vertical wall 13, with the lowermost vertical wall 13 orthogonally oriented relative to a floor surface 14. A first anchor member 15 is mounted to the uppermost stair vertical wall 12 and includes a first anchor plate 16, including plate fasteners 17 directed therethrough for securement of the anchor member 15 to the uppermost vertical wall 12, with the anchor plate 16 including a first anchor boss 18 defined by a predetermined length, including a first anchor boss bore 19 directed coextensively and coaxially through the boss 18. A plurality of slide block members 20, as illustrated in FIG. 1 for example, are arranged in a pivotal inter-relationship and are each defined by a block top wall 21 spaced from and parallel a block bottom wall 22 to include spaced side walls 23. The side walls 23 include side wall flanges 24 extending upwardly and projecting above the block top wall 21 to contain an individual for sliding upon the top wall 21. The block 20 includes a block rear wall 25 and a block front wall 26. Rear wall flanges 28 project exteriorly of the rear wall 25 and are defined by a predetermined spacing therebetween substantially equal to the predetermined length of the anchor boss 18 and a predetermined length defined by a front wall mounting boss 31 that is mounted to the front wall 26. The rear wall flanges 28 mounted to each block rear wall 25 are spaced apart a predetermined spacing to receive a respective front wall mounting boss 31 therebetween, and include rear wall flange bores 29 that are coaxially aligned for alignment with a front wall mounting boss bore 32. A first anchor pin 15*a* is arranged for directing through the first anchor boss bore 19 and associated bottom wall flanges 34 that are also spaced apart the predetermined spacing to receive the first anchor boss 18 therebetween. Bottom wall flange bores 35 that are coaxially aligned are thereafter aligned with the front wall mounting boss bores 32 to receive the first anchor pin 15*a*. A second anchor pin 33 is directed through the coaxially aligned rear wall flange bores 29 and a front wall mounting boss 31 of a rearwardly oriented slide block 20 to provide a pivotal inter-relationship between adjacent blocks 20. A lowermost block 20*a* includes a plurality of spaced adjacent pairs of bottom wall flanges 36, such as illustrated in the FIG. 12 for example, to provide for adjustment and positioning of the lowermost block 20*a* relative to the second anchor member 37. The second anchor member 37 is defined by a triangular configuration including a second anchor member bottom wall 38 orthogonally oriented relative to a second anchor member rear wall 39 positioned in contiguous communication with the lowermost vertical wall 13. The bottom wall 38 is mounted in contiguous communication with the floor surface 14. The hypotenuse wall 40 mounts a second anchor boss 41 thereon formed with a second anchor boss bore 42. The second anchor boss bore 42 receives a third anchor pin 43 through one of said pairs of bottom wall flanges 36 and their associated bottom wall flange bores 35. The second anchor boss bore 42, as well as the front wall mounting boss bore 32, the rear wall flange bores 29, and the bottom wall flange bores 35, are arranged in a parallel relationship relative to one another to ensure a pivotal relationship between each of the blocks 20 and 20*a* forming the slide apparatus of the invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy stairway slide apparatus arranged for mounting to a stairway, wherein the stairway includes an uppermost stair vertical wall and a lowermost stair vertical wall in association with a floor surface, wherein the apparatus comprises, a first anchor member arranged for securement to the uppermost stair vertical wall, and a second anchor member arranged for securement to the lowermost stair vertical wall and the floor surface, and at least one slide block pivotally mounted to the first anchor member, and a lowermost slide block, the lowermost slide block pivotally mounted to the slide block and the second anchor member, and the slide block includes a block top wall spaced from a block bottom wall, and spaced side walls, and a block front wall spaced from a block rear wall, the block rear wall includes a plurality of rear wall flanges spaced apart a predetermined spacing, each flange of the rear wall flanges includes a rear wall flange bore directed through each rear wall flange, wherein the rear wall flange bores are coaxially aligned relative to one another, and the first anchor member includes a first anchor boss defined by a predetermined length substantially equal to the predetermined spacing defined between the rear wall flanges, and the first anchor boss includes a first anchor boss bore coextensive through the first anchor boss, and the first anchor boss bore and each rear wall flange bore are coaxially aligned, and a first anchor pin is directed through the first anchor boss bore and each rear wall flange bore to pivotally mount the slide block to the first anchor member.

2. An apparatus as set forth in claim 1 wherein the lowermost slide block includes a lowermost slide block rear wall, and the lowermost slide block rear wall includes a plurality of lowermost slide block rear wall flanges, wherein each of the lowermost slide block rear wall flanges are spaced apart the predetermined spacing and each include a lowermost rear wall flange bore, and the slide block includes a front wall mounting boss fixedly mounted to the block front wall of the slide block, wherein the front wall mounting boss includes a front wall mounting boss bore, and wherein the front wall mounting boss is defined by a predetermined length arranged for reception within the lowermost slide block rear wall flanges, and including a front wall mounting boss bore, and a second pin directed through the front wall mounting boss bore and each lowermost slide block rear wall flange bore to pivotally mount the slide block to the lowermost slide block.

3. An apparatus as set forth in claim 2 wherein each side wall of the slide block includes a side wall flange projecting above the block top wall, and the lowermost slide block includes a lowermost slide block top wall and includes lowermost slide block side walls, wherein the lowermost slide block side walls include lowermost slide block wall flanges projecting above the lowermost slide block top wall.

4. An apparatus as set forth in claim 3 wherein the slide block bottom wall includes a plurality of spaced bottom wall flanges spaced apart the predetermined spacing and each bottom wall flange includes a bottom wall flange bore, the bottom wall flanges are arranged to permit reception of the first anchor boss therebetween to include a further anchor pin directed through the bottom wall flange bores and the first anchor boss bore, wherein the bottom wall flange bores are positioned adjacent the slide block rear wall.

5. An apparatus as set forth in claim 4 wherein the second anchor member is defined by a triangular cross-sectional configuration including a second anchor member bottom wall and a second anchor rear wall arranged for mounting to the respective lowermost vertical wall and the floor surface respectively, with a hypotenuse wall communicating with the bottom wall and rear wall, the hypotenuse wall including a second anchor boss mounted thereon, the second anchor boss including a second anchor boss bore, and the lowermost slide block including plural pairs of bottom wall flanges, each pair of bottom wall flanges includes aligned bottom wall flange pair bores to permit reception of a yet further anchor pin directed through the second anchor boss bore and a pair of said pairs of bottom wall flanges.

6. An apparatus as set forth in claim 5 wherein the second anchor boss bore, the front wall mounting boss bore, the rear wall flange bores, and the bottom wall flange bores are arranged parallel relative to one another.

* * * * *